United States Patent [19]

Gordon

[11] Patent Number: 4,925,020

[45] Date of Patent: May 15, 1990

[54] ENVIRONMENTALLY SOUND CARRIER PACKAGE

[76] Inventor: Joan E. Gordon, 260 E. Chestnut St., Chicago, Ill. 60611

[21] Appl. No.: 385,228

[22] Filed: Jul. 25, 1989

[51] Int. Cl.[5] ..... B65D 75/58

[52] U.S. Cl. ..... 206/150; 206/620; 206/824

[58] Field of Search ..... 206/150, 824, 145, 620, 206/151

[56] References Cited

U.S. PATENT DOCUMENTS

| | | | |
|---|---|---|---|
| 2,997,169 | 8/1961 | Poupitch . | |
| 3,350,131 | 10/1967 | Tanzer | 206/151 X |
| 3,504,790 | 4/1970 | Owen . | |
| 3,721,337 | 3/1973 | Braun et al. . | |
| 4,024,950 | 5/1977 | Werth | 206/150 |
| 4,064,989 | 12/1977 | Olsen | 206/151 X |

FOREIGN PATENT DOCUMENTS

| | | | |
|---|---|---|---|
| 963852 | 3/1975 | Canada | 206/150 |

*Primary Examiner*—William Price

*Attorney, Agent, or Firm*—Neuman, Williams Anderson & Olson

[57] ABSTRACT

A container package including a series of similarly configured containers maintained in adjacent relation by a series of interconnected rings formed from a resilient deformable material each surrounding one of the containers of the container package. A plastic strip that passes through a loop located on a container and attaches to its surrounding ring, or a bracket attached to the container straddling the ring, provides a permanent connection between each container and its surrounding ring. The rings are weakened either side of the connection so that on removal of a container from a ring the stress caused to the ring by the connection to the container ruptures the ring. This prevents wildlife from becoming entangled in unruptured rings of plastic carriers once the package is discarded.

26 Claims, 1 Drawing Sheet

ENVIRONMENTALLY SOUND CARRIER PACKAGE

BACKGROUND OF THE INVENTION

1. Field of the Invention

The invention relates to an environmentally sound container package of the type that includes a carrier device for maintaining a number of similar containers in adjacent relation for ease of handling. More particularly the invention relates to a release mechanism by which the removal of individual containers from the carrier necessarily breaks the continuity of the rings in which the containers are housed by providing a physical connection between each ring and the container it houses.

2. Description of the Prior Art

Over recent years there has been growing awareness of the effect on the environment of the vast quantities of non-biodegradable waste products generated each year. Of particular concern in this respect are non-biodegradable plastics products, 20 million tons of which are produced each year by the United States alone. Plastics are more difficult to dispose of than other waste products as they cannot readily be recycled because of risk of contamination and are often not suitable for burning as they may release toxic substances such as dioxins. The alternatives for disposal are therefore limited to burying plastic waste in landfills, or dumping it in the ocean where it can directly affect wildlife. As new sites for landfills are becoming increasingly difficult to establish due to resistance from residents in the vicinity of proposed sites, dumping at sea is often the preferred option. Dumping in smaller bodies of water also exists as a result of waste cast off by recreational boaters all over the world.

Many types of plastic packaging are a direct danger to wildlife. Recently, public attention has been alerted to the dangers to wildlife of the plastic yolks commonly used in six-packs to hold cans and bottles together. The removal of cans or bottles from a yolk typically leaves the rings that were surrounding the bottles unbroken. A large proportion of these yolks find their way into the ocean and other waterways where tragically wildlife such as seals, turtles, fish and birds can become hopelessly entangled in the rings. When entangled, these animals are likely to perish due to strangulation, starvation, or infection developed as a result of the plastic cutting into flesh.

Ultimately it is desirable for all plastics to be degradable, but although some progress has been made in this respect, commercial considerations have limited the present extent of their market penetration. Even if this ideal is achieved, yolks made from degradable plastics might still be lethal to wildlife prior to degradation. It is obviously desirable therefore to provide a carrier for a container package, such as a six-pack yolk, that does not present a danger of entanglement to wildlife.

The present invention provides such a carrier that minimizes the danger of animal entanglement by ensuring that the rings of the carrier are ruptured on removal of each can or bottle from a carrier.

OBJECTS OF THE INVENTION

Accordingly it is an object of this invention to provide an improved carrier package that meets the aforementioned requirements.

It is a specific object of this invention to provide a carrier package that poses significantly less threat to the environment than existing plastic container packages.

It is a more specific object of this invention to provide a carrier package that is less likely to endanger wildlife through entanglement than existing plastic carriers.

It is a another object of this invention to provide a carrier that is rendered less detrimental to wildlife prior to disposal, by the performance of operations necessary for the removal of a can, bottle, or other large container from its carrier.

SUMMARY OF THE INVENTION

In accordance with one embodiment of this invention a container package which achieves the foregoing objects includes a series of similarly configured containers maintained in adjacent relation by a series of interconnected rings formed from a resilient deformable material each surrounding one of the containers of the container package. Connection means attaches each of the containers to the ring that surrounds it. A weakened portion of each ring is tearable in response to removal of the container it surrounds from the carrier device to rupture the ring. The connection means is stronger than the weakened portion of the ring so that the continuity of the ring is necessarily broken at the weakened portion as the container is removed from the carrier. The containers are preferably linked to the yolk by means of bracket members that straddle each ring, proximate the weakened portion of the ring. The bracket members are rigidly affixed to the containers and cause the rings to rupture as the containers are removed from the yolk. Alternatively, the containers can be linked to the ring by a resilient strip attached to the ring to form a loop that passes through an eyelet fixed to the container. Another alternative linkage possible with push-tab can packages is achieved by passing the resilient strip through the holes already present on the push-tab.

BRIEF DESCRIPTION OF THE DRAWINGS

For a more complete understanding of this invention, reference should now be made to the embodiment illustrated in greater detail in the accompanying drawings and described by way of example only. In the drawings.

DETAILED DESCRIPTION OF THE DRAWINGS

Figure 1:
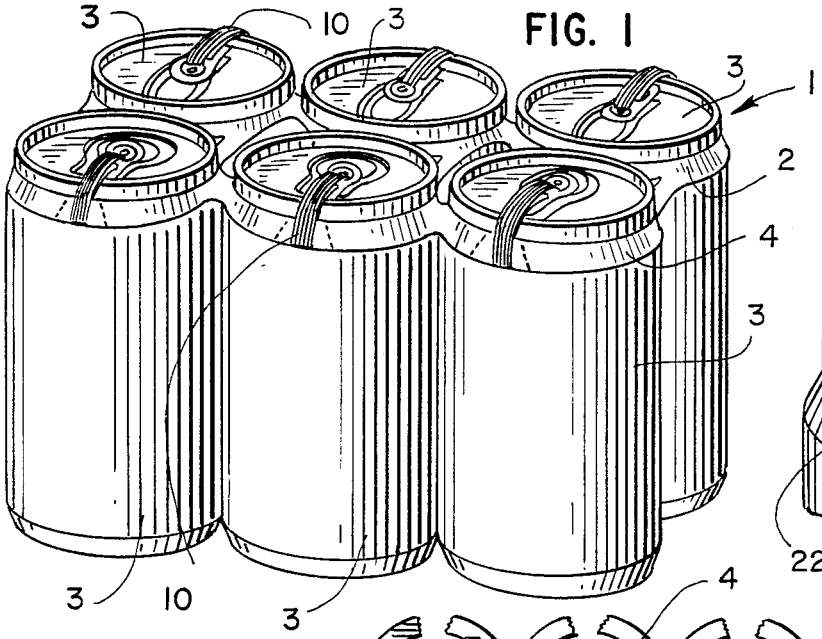
FIG. 1 is a perspective view of a six-pack of push-tab cans of one embodiment of this invention.

Turning to FIG. 1 a perspective view of a six-pack 1 can be seen showing a yolk 2 for holding a series of similar push-tab cans each designated 3. Each can 3 is maintained in its position relative to the other cans of the six-pack by the yolk 2. Each can 3 is engaged by one of the interconnecting rings 4 that make up the yolk 2.

Figure 3:
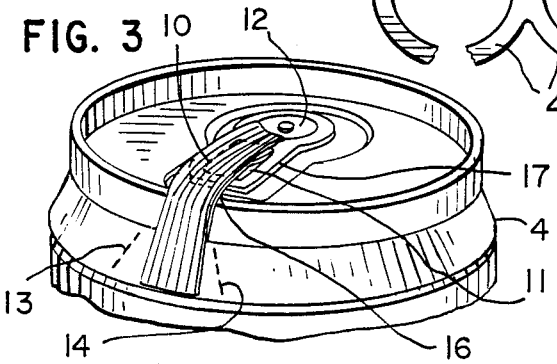
FIG. 3 is a partial perspective view of one of the cans of FIG. 1 showing the connection between the yolk and the push-tab.

In FIG. 3 the design of the connection between the cans 3 and the rings 4 can be seen more clearly. A plastic strip 10 is passed through both loops 11, 12 of the push-tab as shown. Both ends of the plastic strip are heat sealed to the ring 4. The ring 4 has perforated lines 13, 14 located one on either side of the point of attachment of the strip 10 to the ring 4, to weaken the ring so that it is tearable in response to removal of the can from the ring.

Figure 4:
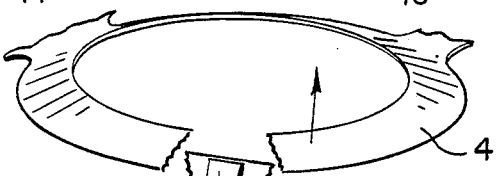
FIG. 4 is a partial perspective view of one of the cans of FIG. 1 on removal from the yolk.
Figure 4:
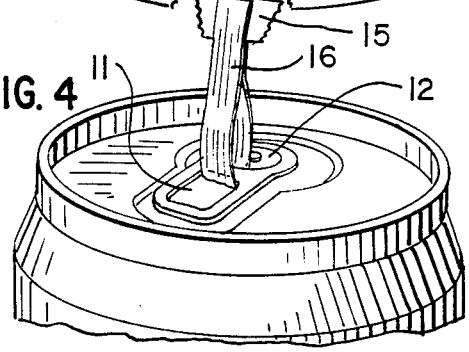

The yolk 2 is designed so that removal of a can is achieved in a conventional manner by a customer-familiar downward pull on the can. As this familiar action is executed, the can 3 is decoupled from engagement with the ring 4 leaving the strip 10 as the only connection between the can 3 and the ring 4. The weakened lines 13, 14 yield as the can 3 is removed from the yolk 2 and the ring 4 is ruptured as shown in FIG. 4 with the strip 10 and detached portion 15 of the ring 4 remaining attached to the can 3. This arrangement has the advantage of utilizing loops already existing on the can to connect the can to the yolk, reducing the number of additions to the can necessary to implement the invention. The strip by necessity should connect the can to the yolk by utilizing the inner loop 12 on the push-tab since using the outer loop 11 of finger grip 17 results in a premature opening of the can.

The most important characteristic of the physical connection between the can and the ring is its strength. For additional strength and to prevent possible breakage of the plastic strip prior to removal of the can, one or more strands of fiber 16 may be pressure sealed along the length of the strip, thus lessening the chance of the plastic strip being severed by a sharp object or rough edges on the can. Alternatively the plastic strip 10 may be entirely replaced by strands of fiber of the required strength. This arrangement may be preferable as some fibers are less prone to severance than plastic and are degradable thereby avoiding an increase in the tonnage of non-degradable waste produced each year, although the amount of additional plastic is insignificant when compared with the benefit achieved in making the carrier safe against entanglement, thus saving the lives of thousands of wildlife.

None of the connections through strips 10 must break under the force required to rupture the ring at the weakened lines 13, 14 in order that the rupture of the ring 4 is guaranteed each time a can 3 is removed from the yolk 2. As each can is removed in this manner each ring in turn is ruptured until the yolk 2 has no remaining unruptured rings and is configured as shown in FIG. 4. As none of the rings remain intact, on disposal, the yolk does not pose a threat to wildlife as animals are no longer in danger of being entangled in unruptured rings.

Figure 5:
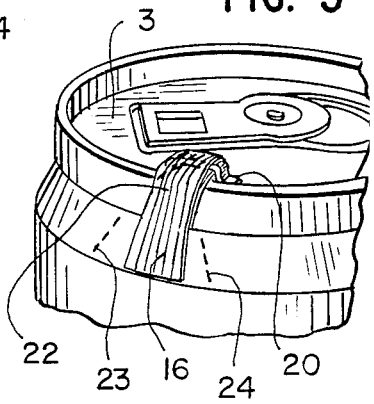
FIG. 5 shows a partial perspective view of a push-tab can having an alternative arrangement for the connection of the can to the yolk.
Figure 2:
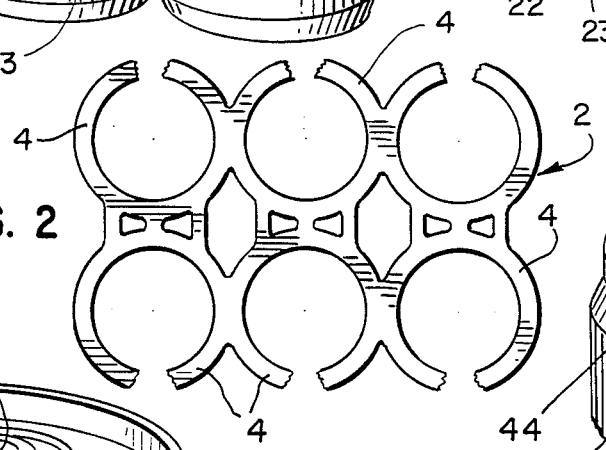
FIG. 2 is a top elevation of the yolk of FIG. 1 after the removal of all the cans retained therein.

FIG. 5 shows an alternative embodiment of the invention for connecting a push-tab type can 3 to a yolk 2 that includes an eyelet 20, welded or otherwise connected to the top of the can 3. A strip of fiber reinforced plastic 22 is passed through the eyelet 20 and bent back on itself as shown. Both ends of the plastic strip are heat sealed to the yolk 2 and lines of perforations 23, 24 weaken the rings of the yolk so that the continuity of the ring is broken as the can 3 is pulled from the yolk 2 in a similar manner to the cans of FIG. 1. The eyelet 20 is located close to the edge of the can to minimize the length of strip 22 necessary to complete the physical connection between the ring 4 and the can 3. In this position the eyelet would also not interfere with drinking from the can. It is also important that the eyelet does not have any sharp edges that might sever the plastic strip 5.

The advantage of this method of attachment resides in the fact that it is utilizable with a variety of types of can. This means that only one technological development is required to implement the invention whatever the can type. Moreover, in mass production of carriers according to this embodiment of the invention, the orientation of the can would not be critical to the positioning of the eyelet 20. Fabrication of the connection between the can and the yolk would therefore be able to be achieved more economically.

Figure 6:
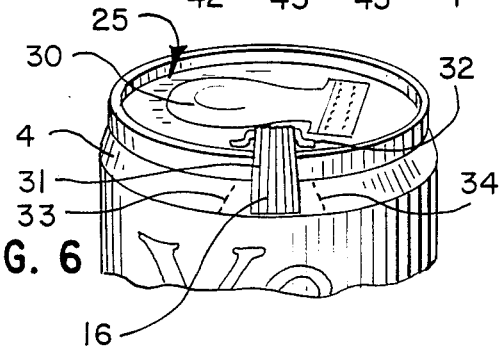
FIG. 6 is a perspective view of a foil top can having the can attached to the yolk in the same manner as the can of FIG. 5.
Figure 7:
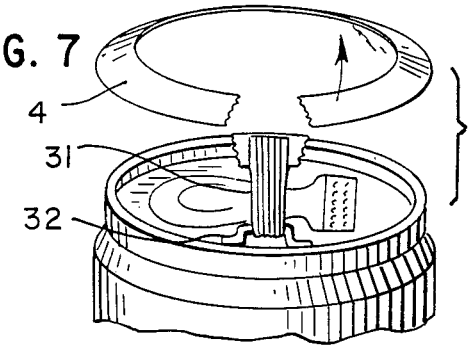
FIG. 7 is a perspective view of the can of FIG. 6 on removal from the yolk.

FIG. 6 shows an alternative design of can 25 that has a foil top 30. The design of the attachment between the yolk 2 and the can 25 is the same as for the push-tab can 3 shown in FIG. 5. A reinforced plastic strip 31 passes through an eyelet 32 and is sealed to the ring 4 of the yolk 2. On removal of the can 25 from the yolk 2, again in the conventional manner by a customer familiar downward pull on the can, the ring 4 is ruptured at perforated lines 33, 34 and the strip 31 and ring portion 35 remain attached to the can 25 as can be seen in FIG. 7. The detachment of the can illustrated in FIG. 5 from its surrounding ring would result in rupture of the ring in the same manner as that illustrated in FIG. 7.

Figure 8:
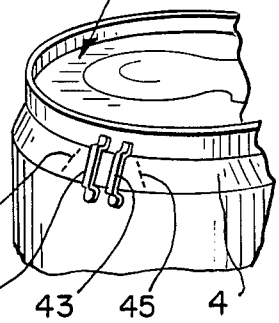
FIG. 8 is a perspective view of a can showing an alternative connection between the can and the yolk.

FIG. 8 shows another alternative embodiment for the attachment between a container and the ring surrounding it. This embodiment has the advantage of adding no additional plastic to the container package and is readily adaptable to automation of the assembling procedure.

The ring 4 is connected to the can 40 by a pair of metal brads 42, 43 one located in close proximity to each of the weakened lines 44, 45 of the ring. On removal of the can 40 from the ring 4 in the customer-familiar manner, the brads will engage with the ring causing it to rupture along the weakened lines. This will break the continuity of the ring and thus render the package less dangerous to wildlife in a manner similar to that described for the previous embodiments.

While three preferred embodiments of this invention are illustrated, it will be understood, of course that the invention is not limited to these embodiments, the principles disclosed in detail above to render the six-pack yolk safe can equally be applied to rendering the plastic rings from larger container packages safer for wildlife. Those skilled in the art to which the invention pertains may make modifications and other embodiments employing the principles of the invention, particularly upon considering the foregoing teachings.

What is claimed is:

1. A container package comprising:

a series of similarly configured containers;

a series of interconnected rings formed from a resilient deformable material, each surrounding and engaging one of said array of containers for maintaining said containers in adjacent relation and having a weakened portion extending across the girth of said ring; and connection means for linking each said ring to the container with which it is engaged such that on removal of said container from said engaging ring, stress applied to said ring by said connection means ruptures said ring at said weakened portion.

2. The package of claim 1 wherein at least one of said connection means comprises a bracket member straddling the girth of one of said rings proximate said weakened portion, and rigidly attached to the engaged container so that removal of said container from said ring requires rupture of said ring at said weakened portion.

3. The package of claim 2 wherein said weakened portion is defined by a pair of perforated lines each extending across the girth of said ring.

4. The package of claim 3 wherein said bracket member comprises a pair of brackets one disposed proximate each of said perforated lines.

5. The package of claim 4 wherein said brackets are metal brads fixed to said container.

6. The package of claim 1 wherein at least one of said connection means comprises a resilient strip and a loop anchored to one of said containers, said resilient strip passing through said loop and being attached at both ends to the ring engaging the container to form a continuous link interconnected with said loop.

7. The package of claim 6 wherein said resilient strip is plastic.

8. The package of claim 7 wherein each said plastic strip is attached to one said ring by pressure sealing.

9. The package of claim 7 wherein said plastic strip is reinforced with fibers.

10. The package of claim 6 wherein said weakened portion is defined by a pair of perforated lines each extending across the girth of each said ring, one of said lines being located on either side of said strip.

11. The package of claim 6 wherein said loop is an eyelet rigidly affixed to one said container.

12. The package of claim 6 wherein said resilient strip between each said ring and the container it engages is taut.

13. A container package comprising:

a series of similar substantially cylindrical containers;

a series of interconnected rings formed from a resilient plastic material, each surrounding and engaging one of said array of containers for maintaining said containers in adjacent relation and having a weakened portion extending across the girth of said ring; and connection means for attaching each said ring to the container with which it is engaged such that on removal of said container from said engaging ring, stress applied to said ring by said connection means ruptures said ring at said weakened portion.

14. The package of claim 13 wherein at least one of said connection means comprises a bracket member straddling the girth of one of said rings proximate said weakened portion, and rigidly attached to the engaged container so that removal of said container from said ring requires rupture of said ring at said weakened portion.

15. The package of claim 14 wherein said weakened portion is defined by a pair of perforated lines each extending across the girth of said ring.

16. The package of claim 15 wherein said bracket member comprises a pair of brackets are disposed proximate each of said perforated lines.

17. The package of claim 16 wherein said brackets are metal brads affixed to said container.

18. The package of claim 13 wherein said connection means comprises a resilient strip and a loop anchored to each said container, said resilient strip passing through said loop and being attached at both ends to the ring engaging the container to form a continuous link interconnected with said loop.

19. The package of claim 18 wherein said resilient strip is plastic.

20. The package of claim 19 wherein each said plastic strip is attached to one said ring by pressure sealing.

21. The package of claim 20 wherein said plastic strip is reinforced with fibers.

22. The package of claim 18 wherein said weakened portion is defined by a pair of perforated lines extending across the girth of each said ring, one of said lines being located on either side of said strip.

23. The package of claim 18 wherein at least one of said container has a top side having a push-tab mechanism for accessing the contents of said container said push-tab having first and second holes separated by a bar, and wherein said first and second holes and said bar form said loop.

24. The package of claim 23 wherein said resilient strip is plastic.

25. The package of claim 24 wherein each said plastic strip is attached to its corresponding ring by pressure sealing.

26. The package of claim 24 wherein at least one of said plastic strips is reinforced with fibers.

* * * * *

UNITED STATES PATENT AND TRADEMARK OFFICE
CERTIFICATE OF CORRECTION

PATENT NO. : 4,925,020

DATED : May 15, 1990

INVENTOR(S) : Gordon

It is certified that error appears in the above-identified patent and that said Letters Patent is hereby corrected as shown below:

In Column 1, line 40 of the patent, delete "yolks" and substitute --yokes-- therefor;

In Column 1, line 42 of the patent, delete "yolk" and substitute --yoke-- therefor;

In Column 1, line 44 of the patent, delete "yolks" and substitute --yokes-- therefor;

In Column 1, line 55 of the patent, delete "yolks" and substitute --yokes-- therefor;

In Column 1, line 58 of the patent, delete "yolk" and substitute --yoke-- therefor;

In Column 2, line 28 of the patent, delete "yolk" and substitute --yoke-- therefor;

In Column 2, line 32 of the patent, delete "yolk" and substitute --yoke-- therefor;

In Column 2, line 47 of the patent, delete "yolk" and substitute --yoke-- therefor;

In Column 2, line 50 of the patent, delete "yolk" and substitute --yoke-- therefor;

In Column 2, line 53 of the patent, delete "yolk" and substitute --yoke-- therefor;

UNITED STATES PATENT AND TRADEMARK OFFICE

CERTIFICATE OF CORRECTION

PATENT NO. : 4,925,020

DATED : May 15, 1990

INVENTOR(S) : Gordon

It is certified that error appears in the above-identified patent and that said Letters Patent is hereby corrected as shown below:

In Column 2, line 56 of the patent, delete "yolk" and substitute --yoke-- therefor;

In Column 2, line 58 of the patent, delete "yolk" and substitute --yoke-- therefor;

In Column 2, line 61 of the patent, delete "yolk" and substitute --yoke-- therefor;

In Column 2, line 63 of the patent, delete "yolk" and substitute --yoke-- therefor;

In Column 3, line 3 of the patent, delete "yolk" and substitute --yoke-- therefor;

In Column 3, line 4 of the patent, delete "yolk" and substitute --yoke-- therefor;

In Column 3, line 14 of the patent, delete "yolk" and substitute --yoke-- therefor;

In Column 3, line 20 of the patent, delete "yolk" and substitute --yoke-- therefor;

In Column 3, line 25 of the patent, delete "yolk" and substitute --yoke-- therefor;

In Column 3, line 28 of the patent, delete "yolk" and substitute --yoke-- therefor;

In Column 3, line 52 of the patent, delete "yolk" and substitute --yoke-- therefor;

UNITED STATES PATENT AND TRADEMARK OFFICE

CERTIFICATE OF CORRECTION

PATENT NO. : 4,925,020

DATED : May 15, 1990

INVENTOR(S) : Gordon

It is certified that error appears in the above-identified patent and that said Letters Patent is hereby corrected as shown below:

In Column 3, line 53 of the patent, delete "yolk" and substitute --yoke-- therefor;

In Column 3, line 55 of the patent, delete "yolk" and substitute --yoke-- therefor;

In Column 3, line 59 of the patent, delete "yolk" and substitute --yoke-- therefor;

In Column 3, line 64 of the patent, delete "yolk" and substitute --yoke-- therefor;

In Column 3, line 65 of the patent, delete "yolk" and substitute --yoke-- therefor;

In Column 3, line 66 of the patent, delete "yolk" and substitute --yoke-- therefor;

In Column 4, line 15 of the patent, delete "yolk" and substitute --yoke-- therefor;

In Column 4, line 19 of the patent, delete "yolk" and substitute --yoke-- therefor;

UNITED STATES PATENT AND TRADEMARK OFFICE

CERTIFICATE OF CORRECTION

PATENT NO. : 4,925,020

DATED : May 15, 1990

INVENTOR(S) : Gordon

It is certified that error appears in the above-identified patent and that said Letters Patent is hereby corrected as shown below:

In Column 4, line 22 of the patent, delete "yolk" and substitute --yoke-- therefor; and In Column 4, line 49 of the patent, delete "yolk" and substitute --yoke--therefor;

Signed and Sealed this

Twenty-fourth Day of December, 1991

*Attest:*

HARRY F. MANBECK, JR.

*Attesting Officer*

*Commissioner of Patents and Trademarks*